US011266190B2

(12) United States Patent
Cleghorn et al.

(10) Patent No.: US 11,266,190 B2
(45) Date of Patent: Mar. 8, 2022

(54) BREACHING CHARGE POCKETS FOR PANTS

(71) Applicant: Kryptek Outdoor Group, LLC, Eagle, ID (US)

(72) Inventors: Josh Cleghorn, Eagle, ID (US); Greg Houser, Eagle, ID (US); Kevin Holland, Eagle, ID (US)

(73) Assignee: Kryptek Outdoor Group LLC, Eagle, ID (US)

( * ) Notice: Subject to any disclaimer, the term of this patent is extended or adjusted under 35 U.S.C. 154(b) by 0 days.

(21) Appl. No.: 16/870,302

(22) Filed: May 8, 2020

(65) Prior Publication Data

US 2020/0359722 A1 Nov. 19, 2020

Related U.S. Application Data

(60) Provisional application No. 62/848,538, filed on May 15, 2019.

(51) Int. Cl.

| | |
|---|---|
| ***A41D 27/20*** | (2006.01) |
| ***A41D 1/06*** | (2006.01) |
| ***A41D 31/18*** | (2019.01) |

(52) U.S. Cl.

CPC ..... *A41D 27/20* (2013.01); *A41D 1/06* (2013.01); *A41D 31/18* (2019.02)

(58) Field of Classification Search

CPC ..... A41D 27/20; A41D 31/18; A41D 27/201; A41D 27/22; A41D 1/06; A41D 27/204; A41D 27/205; A41D 27/207; A41D 27/208; A41D 13/0012; A45F 3/08; A45F 5/02; A45C 13/02

USPC ..... 2/253, 79, 227, 247–250

See application file for complete search history.

(56) References Cited

U.S. PATENT DOCUMENTS

| | | | | |
|---|---|---|---|---|
| 57,072 | A * | 8/1866 | Bell | A41D 27/20 2/250 |
| 859,277 | A * | 7/1907 | Woodworth | A41D 27/20 2/250 |
| 960,651 | A * | 6/1910 | Lipkey | A41D 27/20 2/250 |
| 1,073,479 | A * | 9/1913 | Dunbar | A41D 13/0012 2/94 |

(Continued)

FOREIGN PATENT DOCUMENTS

| | | | | |
|---|---|---|---|---|
| FR | 2476453 | A1 * | 8/1981 | A41D 13/02 |

OTHER PUBLICATIONS

Smith, Carolyn, Double welt pocket with looped button closure, Mar. 3, 2016, Handmade By Carolyn, https://handmadebycarolyn.com.au/2014/01/double-welt-pocket-with-looped-button.html, p. 1-11 (Year: 2016).*

(Continued)

*Primary Examiner* — Jameson D Collier
(74) *Attorney, Agent, or Firm* — K&L Gates LLP

(57) ABSTRACT

Embodiments of a breaching charge pocket for a pair of pants are disclosed. In an embodiment, the breaching charge pocket includes a plurality of compartments. Each compartment includes an upper end and a lower end. The upper end of each compartment includes an opening that is biased to a closed position. In addition, the breaching charge pocket includes a plurality of elastic loops. Each of the elastic loops is disposed at the opening of a corresponding one of the plurality of compartments.

19 Claims, 7 Drawing Sheets

(56) References Cited

U.S. PATENT DOCUMENTS 1,091,927 A * 3/1914 Greenwood ..... A41D 27/20 2/253
1,212,513 A * 1/1917 Langerman ..... A41D 13/0012 2/94
1,273,419 A * 7/1918 Stewart ..... A41D 27/20 2/249
1,491,711 A * 4/1924 Levine ..... A41D 27/20 2/250
1,649,932 A * 11/1927 Sweet ..... A41D 27/20 2/250
1,692,200 A * 11/1928 Capliano ..... A44C 19/00 2/249
1,780,204 A * 11/1930 Mastin ..... A41D 27/20 2/253
1,982,100 A * 11/1934 Heile ..... A41D 27/20 2/253
2,375,652 A * 5/1945 Hess ..... A41D 27/207 2/253
2,558,382 A * 6/1951 Previdi ..... A63B 47/001 224/223
2,864,541 A * 12/1958 Altick ..... F42B 39/02 2/102
3,023,421 A * 3/1962 Farah ..... A41D 27/20 2/252
3,320,620 A * 5/1967 Weidler ..... A63B 47/001 2/250
3,629,867 A * 12/1971 Taylor ..... A41D 19/0024 2/160
4,303,239 A * 12/1981 Walsh, Jr. ..... A63B 21/0603 482/105
4,796,790 A * 1/1989 Hamilton ..... A45C 11/00 206/438
5,033,117 A * 7/1991 Fairweather ..... A63B 21/065 2/69
5,517,696 A * 5/1996 Krugler ..... A41D 27/20 2/250
6,412,674 B1 * 7/2002 Lipke ..... A45C 7/00 224/235
6,421,839 B1 * 7/2002 Vo ..... A41D 13/0575 2/227
6,839,917 B1 * 1/2005 Landwehr ..... A41D 13/04 2/22
D545,028 S * 6/2007 Myrick ..... D2/728
7,364,491 B2 * 4/2008 Updyke ..... A41C 3/0035 2/247
7,908,675 B2 * 3/2011 Robinson ..... A41D 27/20 2/247
D639,026 S * 6/2011 Robinson ..... D2/857
8,240,532 B2 * 8/2012 Cragg ..... A45F 3/08 224/648
9,038,869 B2 * 5/2015 Moreau ..... A45F 5/02 224/162
9,394,080 B2 * 7/2016 Beck ..... F42B 39/26
9,557,139 B1 * 1/2017 Miner ..... F41C 33/048
9,648,918 B2 * 5/2017 Grady ..... A45F 5/022
9,759,536 B2 * 9/2017 Gadams ..... B65D 25/20
D818,670 S * 5/2018 Silvestre ..... D2/742
10,281,240 B2 * 5/2019 Cole ..... F41H 1/02
10,352,652 B2 * 7/2019 Higdon, Jr. ..... F41C 33/0236
10,869,539 B2 * 12/2020 Caldwell ..... A45F 3/14
D919,235 S * 5/2021 Li ..... D2/742
2002/0014507 A1 * 2/2002 Snider ..... A45F 5/02 224/671
2007/0175941 A1 * 8/2007 Berry ..... A45F 3/04 224/583
2009/0282600 A1 * 11/2009 Robinson ..... A41D 27/20 2/79
2010/0017943 A1 * 1/2010 Morales ..... A41D 27/20 2/227
2010/0235966 A1 * 9/2010 DeHart ..... A41D 27/20 2/252
2011/0247127 A1 * 10/2011 Pou ..... A41D 13/0012 2/227
2012/0096628 A1 * 4/2012 Grady ..... A45F 5/022 2/249
2016/0003598 A1 * 1/2016 Gadams ..... F42B 39/02 206/3
2017/0352928 A1 * 12/2017 Lingenfelter ..... H01M 10/623
2018/0368560 A1 * 12/2018 Evans ..... A45F 3/06
2019/0298046 A1 * 10/2019 Duncan ..... A45F 5/02
2020/0359722 A1 * 11/2020 Cleghorn ..... A41D 27/201

OTHER PUBLICATIONS

Brandon, Jessica, #20 Completed back welt pocket with loop V1051, Jun. 18, 2016, Sew Like in Paris, http://sewlikeinparis.com/fitting-and-fitting-and-welts-oh-no/20-completed-back-welt-pocket-with-loop-v1051/, p. 1-2 (Year: 2016).*

* cited by examiner

BREACHING CHARGE POCKETS FOR PANTS

PRIORITY CLAIM

This application claims priority to U.S. Provisional Patent Application No. 62/848,538 entitled BREACHING CHARGE POCKETS FOR PANTS filed on May 15, 2019, the entire contents of which are incorporated by reference herein and relied upon.

STATEMENT REGARDING FEDERALLY SPONSORED RESEARCH OR DEVELOPMENT

Not applicable.

BACKGROUND

Door breaching is a process used by military, police, or emergency services to forcibly open closed and/or locked doors. During this process, an explosive charge (which may be referred to herein as a "breaching charge") may be placed on a locked/closed door (or other suitable surface adjacent to the door). Thereafter, the charge may be detonated to force or blow open the door and thereby allow entrance through the open doorway.

SUMMARY

In light of the disclosure herein, and without limiting the scope of the invention in any way, in a first aspect of the present disclosure, which may be combined with any other aspect listed herein unless specified otherwise, a pair of pants includes a pair of legs, and a first breaching charge pocket coupled to a first leg of the pair of legs. The first breaching charge pocket includes a plurality of compartments and a plurality of elastic loops. Each compartment includes an upper end and a lower end. The upper end of each compartment includes an opening that is biased to a closed position. Each elastic loop is disposed at the opening of a corresponding one of the plurality of compartments.

In a second aspect of the present disclosure, which may be combined with any other aspect listed herein unless specified otherwise, a side cargo pocket is coupled to the first leg. The opening of each compartment of the first breaching charge pocket is disposed above the side cargo pocket along the first leg.

In a third aspect of the present disclosure, which may be combined with any other aspect listed herein unless specified otherwise, at least some portion of the compartments is disposed between the side cargo pocket and a leg of a user.

In a fourth aspect of the present disclosure, which may be combined with any other aspect listed herein unless specified otherwise, the first breaching charge pocket comprises a welt that defines the opening of each of the compartments.

In a fifth aspect of the present disclosure, which may be combined with any other aspect listed herein unless specified otherwise, the welt comprises an elastic material that is configured to bias the openings to a closed position.

In a sixth aspect of the present disclosure, which may be combined with any other aspect listed herein unless specified otherwise, the first breaching charge pocket comprises a length that ranges from about 10 inches to about 20 inches.

In a seventh aspect of the present disclosure, which may be combined with any other aspect listed herein unless specified otherwise, the length ranges from about 15 inches to about 20 inches.

In an eighth aspect of the present disclosure, which may be combined with any other aspect listed herein unless specified otherwise, each of the plurality of elastic loops is configured to be disposed about a breaching charge.

In a ninth aspect of the present disclosure, which may be combined with any other aspect listed herein unless specified otherwise, the pair of pants includes a second breaching charge pocket coupled to a second leg of the pair of legs. The second breaching charge pocket includes a plurality of compartments and a plurality of elastic loops. Each compartment includes an upper end and a lower end. The upper end of each compartment includes an opening that is biased to a closed position. Each elastic loop is disposed at an open end of a corresponding one of the plurality of compartments.

In a tenth aspect of the present disclosure, which may be combined with any other aspect listed herein unless specified otherwise, the second breaching charge pocket comprises a welt that defines the opening of each of the compartments.

In an eleventh aspect of the present disclosure, which may be combined with any other aspect listed herein unless specified otherwise, a pair of pants includes a pair of legs, a first breaching charge pocket coupled to a first leg of the pair of legs, and a second breaching charge pocket coupled to a second leg of the pair of legs. The first breaching charge pocket includes a plurality of compartments. Each compartment includes an upper end and a lower end. The upper end of each compartment includes an opening that is biased to a closed position. The second breaching charge pocket includes a plurality of compartments. Each compartment includes an upper end and a lower end. The upper end of each compartment includes an opening that is biased to a closed position.

In a twelfth aspect of the present disclosure, which may be combined with any other aspect listed herein unless specified otherwise, the pair of pants includes a side cargo pocket coupled to each leg. The opening of each compartment of the first breaching charge pocket and the opening of each compartment of the second breaching charge pocket are disposed above the respective side cargo pockets.

In a thirteenth aspect of the present disclosure, which may be combined with any other aspect listed herein unless specified otherwise, the pair of pants includes a plurality of elastic loops. Each elastic loop is disposed at the opening of a corresponding one of the plurality of compartments.

In a fourteenth aspect of the present disclosure, which may be combined with any other aspect listed herein unless specified otherwise, each of the plurality of elastic loops is configured to be disposed about a breaching charge.

In a fifteenth aspect of the present disclosure, which may be combined with any other aspect listed herein unless specified otherwise, the first breaching charge pocket comprises a welt that defines the opening of each of the compartments.

In a sixteenth aspect of the present disclosure, which may be combined with any other aspect listed herein unless specified otherwise, the welt comprises an elastic material that is configured to bias the openings to a closed position.

In a seventeenth aspect of the present disclosure, which may be combined with any other aspect listed herein unless specified otherwise, the second breaching charge pocket comprises a welt that defines the opening of each of the compartments.

In an eighteenth aspect of the present disclosure, which may be combined with any other aspect listed herein unless specified otherwise, the first breaching charge pocket comprises a length that ranges from about 10 inches to about 20 inches.

In a nineteenth aspect of the present disclosure, which may be combined with any other aspect listed herein unless specified otherwise, the length ranges from about 15 inches to about 20 inches.

In a twentieth aspect of the present disclosure, which may be combined with any other aspect listed herein unless specified otherwise, the length of the first breaching charge pocket is different from a length of the second breaching charge pocket.

Additional features and advantages of the disclosed devices, systems, and methods are described in, and will be apparent from, the following Detailed Description and the Figures. The features and advantages described herein are not all-inclusive and, in particular, many additional features and advantages will be apparent to one of ordinary skill in the art in view of the figures and description. Also, any particular embodiment does not have to have all of the advantages listed herein. Moreover, it should be noted that the language used in the specification has been selected for readability and instructional purposes, and not to limit the scope of the inventive subject matter.

BRIEF DESCRIPTION OF THE FIGURES

Understanding that figures depict only typical embodiments of the invention and are not to be considered to be limiting the scope of the present disclosure, the present disclosure is described and explained with additional specificity and detail through the use of the accompanying figures. The figures are listed below.

DETAILED DESCRIPTION

Figure 1:
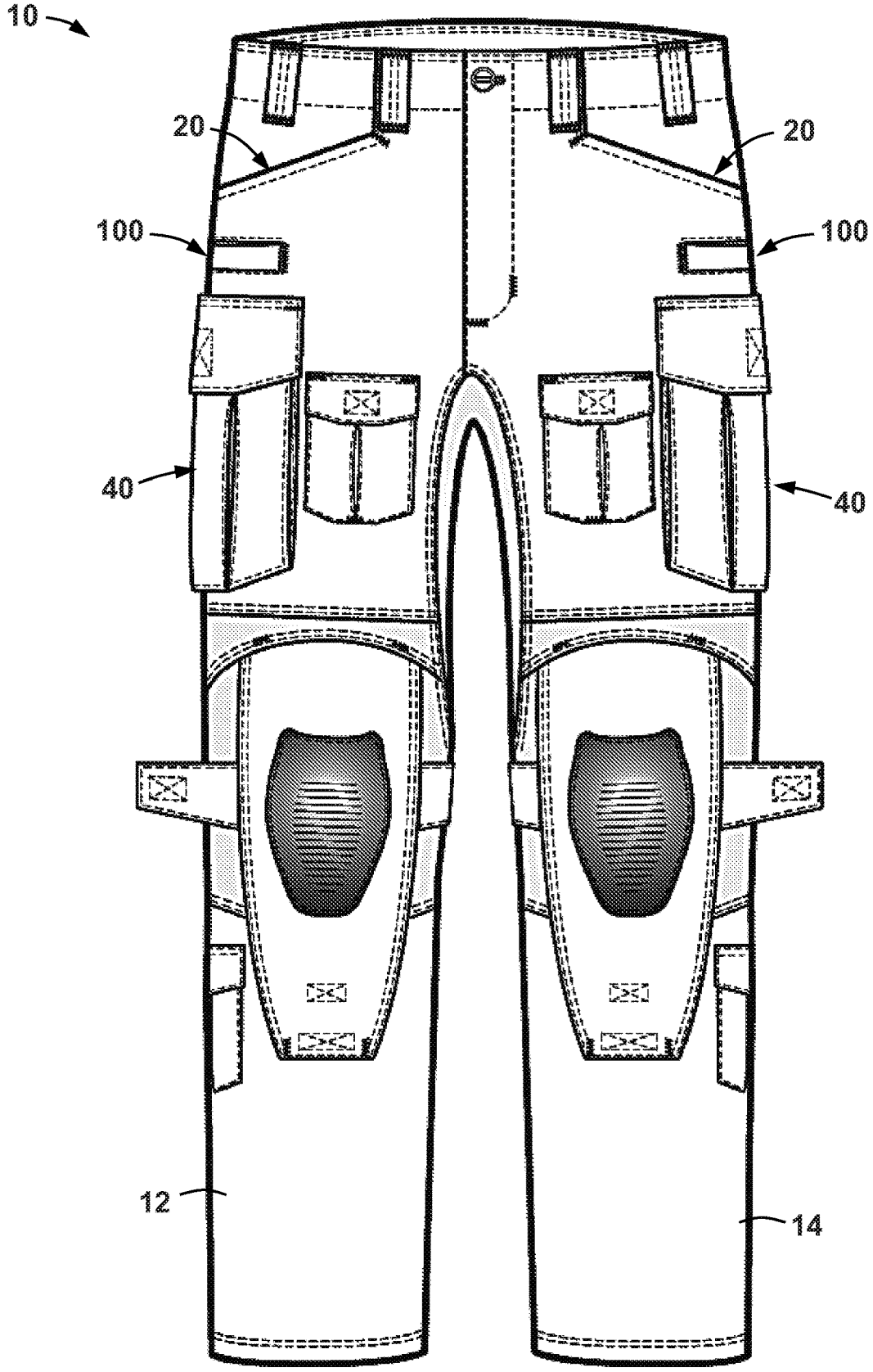
FIG. 1 is a front view of a pair of pants including breaching charge pockets according to some embodiments.

The following discussion is directed to various exemplary embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis. Further, when used herein (including in the claims), the words "about," "generally," "substantially," "approximately," and the like mean within a range of plus or minus 10%.

As previously described, during a door breaching process a breaching charge is placed on or near a closed/locked door and detonated in order to allow access therethrough. During a raid or other similar operation, personnel may typically carry any equipment that may be needed or desired (including breaching charges) on their person. Breaching charges may be stored such that personnel may quickly and easily access them during an operation. However, because breaching charges include highly explosive (and thus dangerous) materials, it may be desirable to store such charges to avoid jarring (at least somewhat) and to allow personnel to safely, quickly, and easily access and grasp the proper charge when desired. Accordingly, embodiments disclosed herein include pants having pockets configured to store and organize breaching charges during operations.

Figure 2:
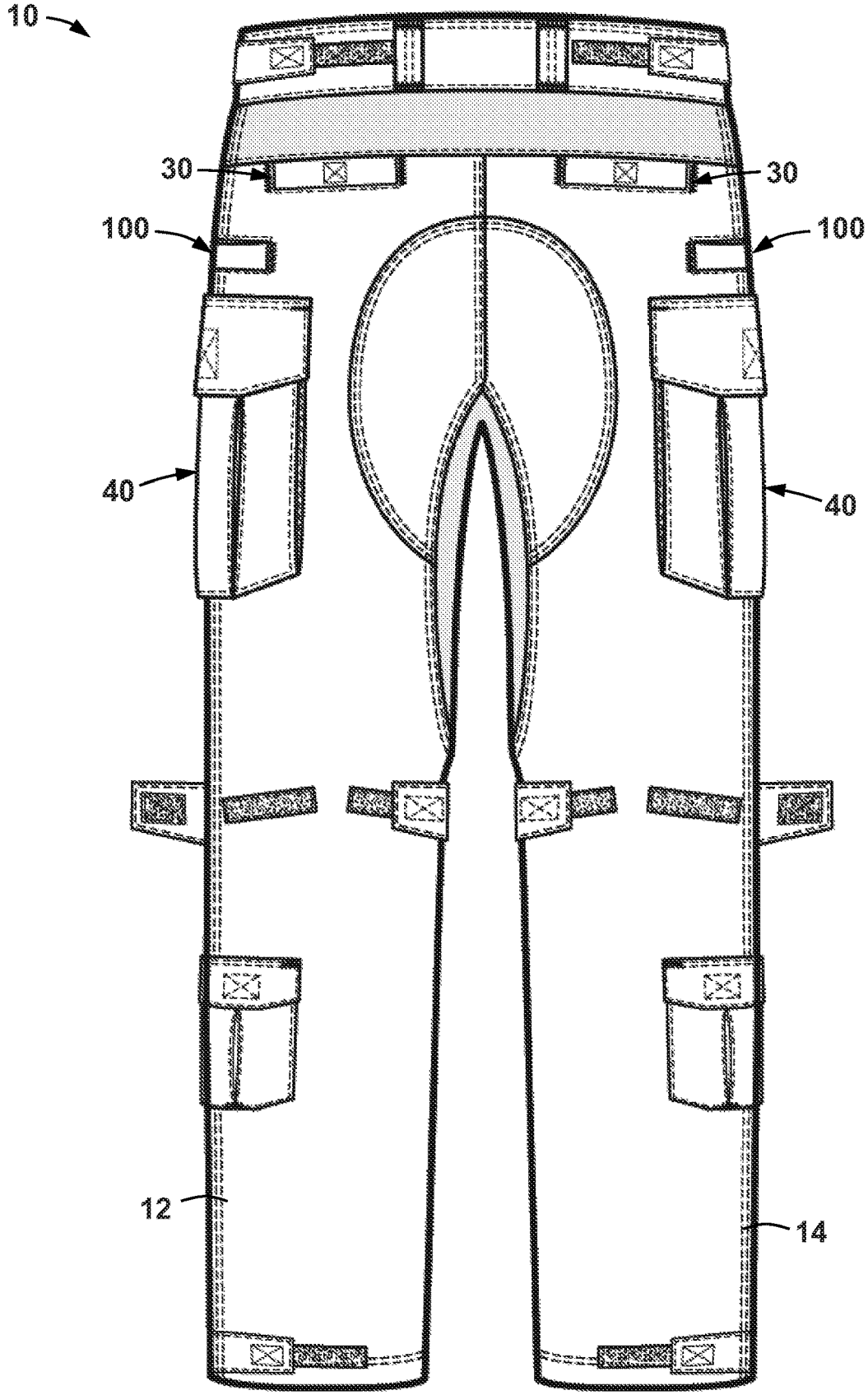
FIG. 2 is a rear view of the pants of FIG. 1.
Figure 3:
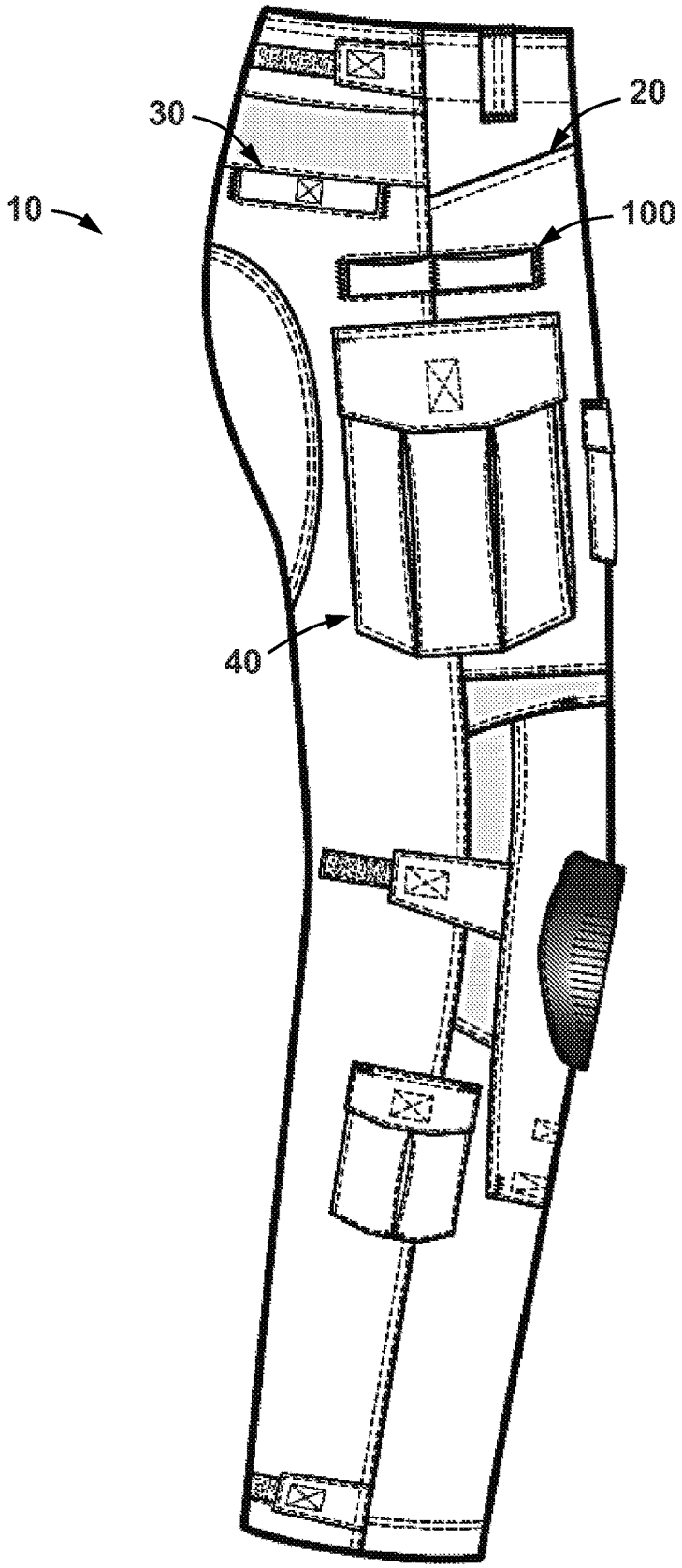
FIG. 3 is a side view of the pants of FIG. 1.

Referring now to FIGS. 1-3, a pair of pants 10 is shown. In some embodiments, pants 10 may be worn by tactical operators (e.g., soldiers, police officers, security and emergency response personnel who possess specialized knowledge, skills and/or training) during a raid or other suitable operation. Pants 10 include a first leg 12 and a second leg 14 joined together by stitching. Each leg 12, 14 includes a front pocket 20 (see FIG. 1), a rear pocket 30 (see FIG. 2), an external side cargo pocket 40, and a breaching charge pocket 100. In FIG. 2, the numerals of first pant leg and second pant leg are reversed such that "12" identifies the second pant leg and "14" identifies the first pant leg. In some embodiments (e.g., such as the embodiment of FIGS. 1-3), the opening (e.g., openings 101, 103 discussed in more detail below) of the breaching charge pocket 100 of each leg 12, 14 is disposed below the front pocket 20 and rear pocket 30 and above the external side cargo pocket 40. In addition, in some embodiments (e.g., again, such as the embodiment of FIGS. 1-3), the breaching charge pocket 100 of each leg 12, 14 is positioned along a side or between the front and back of pants 10. More particularly, in some embodiments, breaching charge pockets 100 are laterally aligned with the external side cargo pocket 40 along the corresponding leg 12, 14. However, it should be appreciated that the placement and relative arrangement of pockets 20, 30, 40, 100 may be altered in various embodiments. Further, In some embodiments (e.g., such as the embodiment of FIGS. 1-3), pants 10 include two breaching charge pockets 100—one breaching charge pocket 100 being disposed on each leg 12, 14. However, in other embodiments, pants 10 may include one breaching charge pocket 100 on one of the legs 12, 14.

As will be described in more detail below, during operations, breaching charges may be disposed within breaching charge pockets 100. As a result, personnel may quickly and safely access the breaching charges via pocket(s) 100. In addition, because breaching charges are placed within breaching charge pocket(s) 100, other pockets of pants 10 (e.g., cargo pockets 40, front pockets 20, rear pockets 30, etc.) may be utilized to hold or store other items of equipment. Further details of breaching charge pockets 100 will now be discussed in more detail below.

Figure 4:
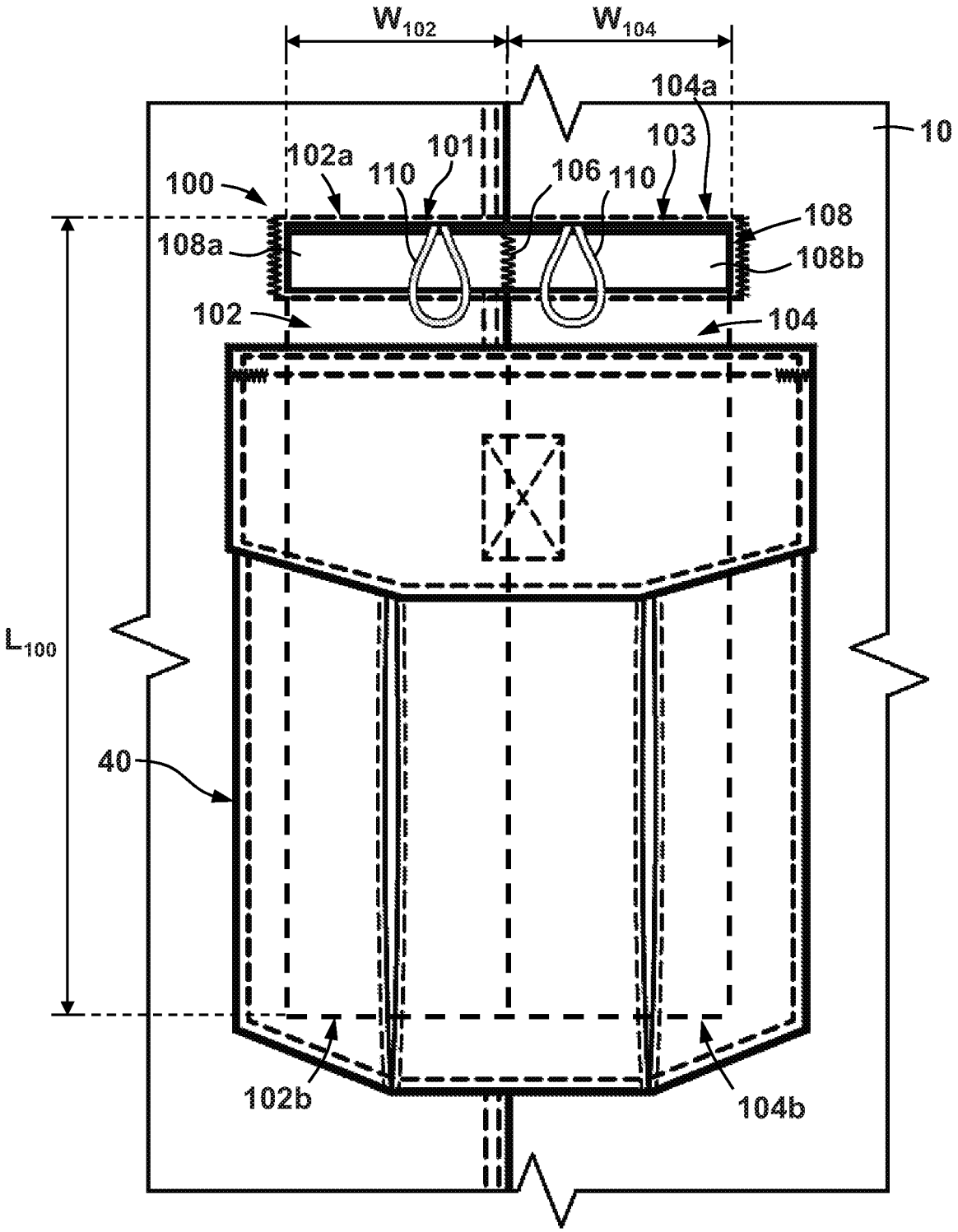
FIG. 4 is a front, external view of one of a breaching charge pocket of the pants of FIG. 1 according to some embodiments.
Figure 5:
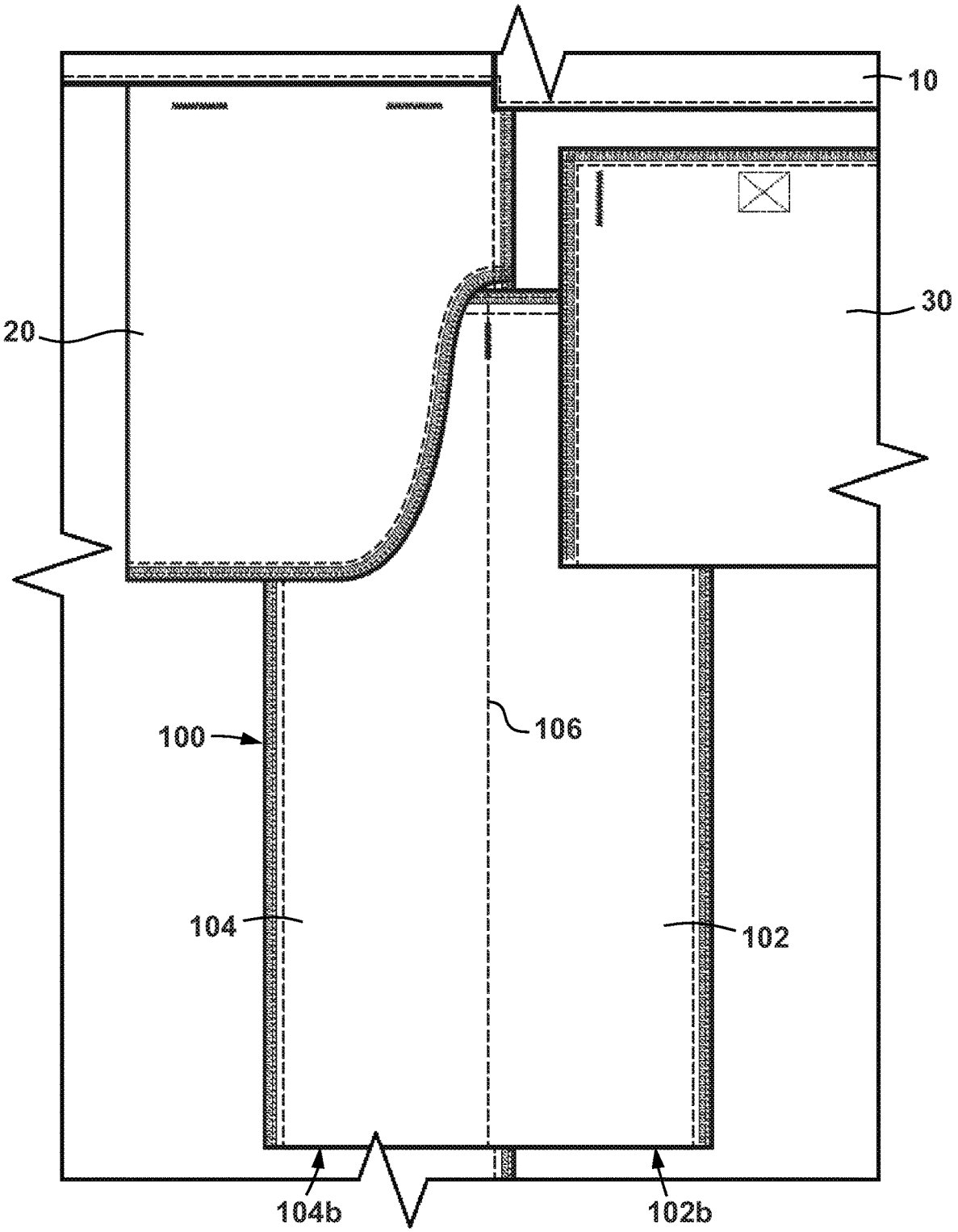
FIGS. 5 and 6 are rear, internal views of the breaching charge pocket of FIG. 4.
Figure 6:
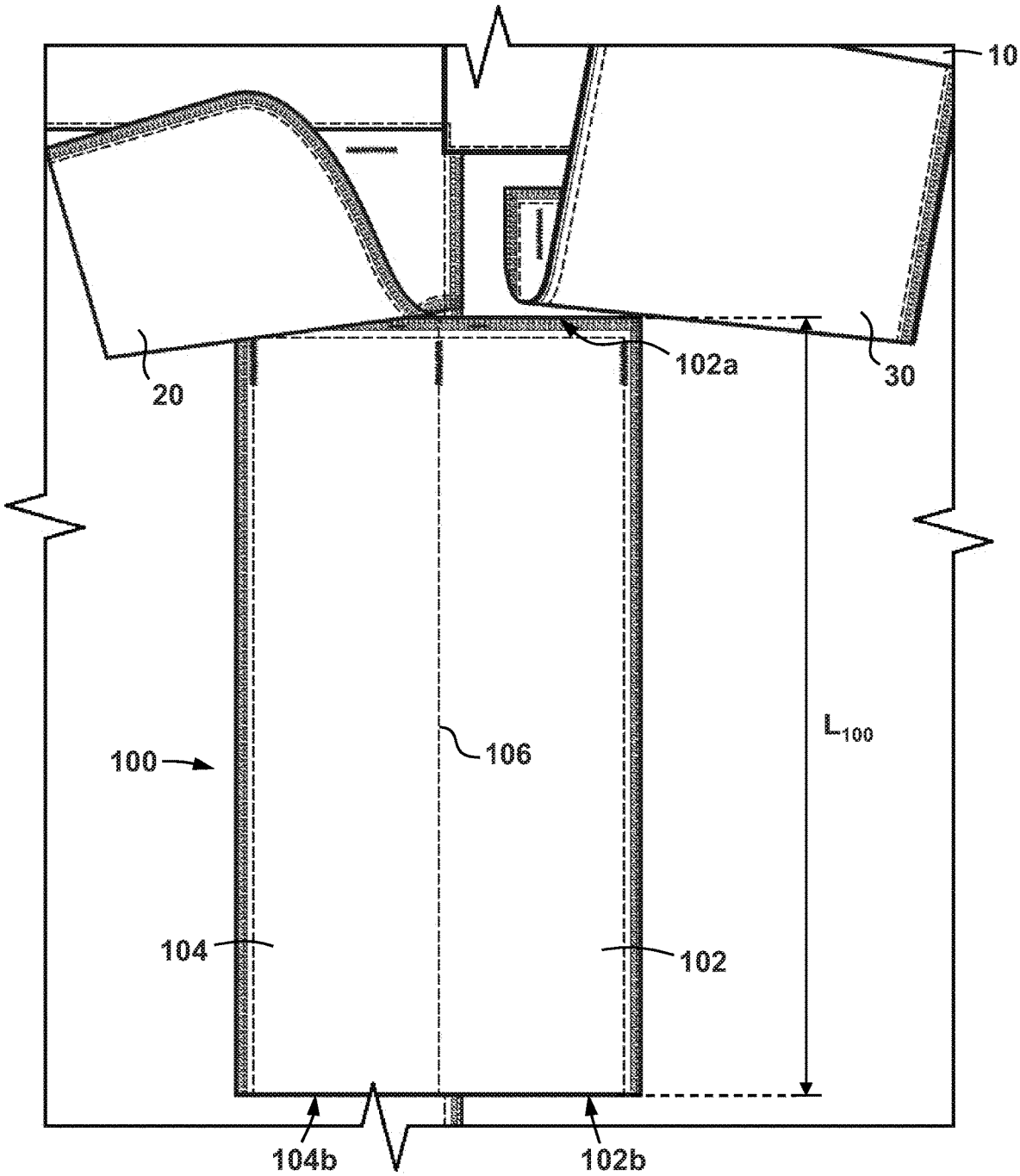

Referring now to FIGS. 4-6, one of the breaching charge pockets 100 of pants 10 (see FIGS. 1-3) is shown, but it should be appreciated that each breaching charge pocket 100 included on pants 10 is configured the same. In some embodiments, breaching charge pocket 100 includes a plurality of compartments 102, 104 (two in this embodiment) that extend from a first or upper end 102*a*, 104*a* to a second or lower end 102*b*, 104*b*, respectively. In other embodiments, breaching charge pocket 100 may define a single compartment (e.g., compartment 102, 104). Similarly, in other embodiments, breaching charge pocket 100 may define more than two compartments (e.g., three or more). In some embodiments, upper ends 102*a*, 104*a* of compartments 102, 104 are open, and lower ends 102*b*, 104*b* are closed such that objects (e.g., breaching charges) may be inserted within compartments 102, 104 via upper ends 102*a*, 104*a*, respectively. Accordingly, upper ends 102*a*, 104*a* may be referred to herein as "open ends," that have openings 101, 103 for compartments 102, 104, respectively, and lower ends 102*b*, 104*b* may be referred to herein as "closed ends," of compartments 102, 104, respectively. In this embodiment, compartments 102, 104 are separated from one another by stitching 106 that extends from upper ends 102*a*, 104*a* to lower ends 102*b*, 104*b*. In addition, as best shown in FIG. 4, a portion (or a majority of) compartments 102, 104 of pocket 100 are disposed behind cargo pocket 40.

As best shown in FIG. 4, in some embodiments, breaching charge pocket 100 is a welt pocket that includes a welt or piping 108 at upper ends 102*a*, 104*a* of compartments 102, 104, respectively. Stitching 106 extends across welt 108 so that welt 108 is separated into a first section or portion 108*a* aligned with first compartment 102 and a second section or portion 108*b* aligned with second compartment 104. Thus, first portion 108*a* of welt 108 defines opening 101 of first compartment 102, and second portion 108*b* of welt 108 defines opening 103 of second compartment 104. In some embodiments, first and second sections 108*a* and 108*b*, respectively, of welt 108 include elastic materials (not shown) inserted therein. Thus, openings 101, 103 may be stretched outward to an open position (or away from the pant 10), but are biased (e.g., by the inserted elastic materials within sections 108*a*, 108*b* of welt 108) to a closed position (or back toward pant 10). Without being limited to this or any other theory, the elastic material within portions 108*a*, 108*b* of welt 108 may retain or hold breaching charges (not shown) that are disposed within compartments 102, 104 during operations. Thus, welt 108 (including portions 108*a*, 108*b*) may be referred to herein as an "elastic welt."

In addition, referring still to FIGS. 4-6, pocket 100 has a total length $L_{100}$ that extends from upper ends 102*a*, 104*a* to lower ends 102*b*, 104*b* of compartments 102, 104, respectively. Length $L_{100}$ may be set such that a breaching charge (not shown) (or a majority thereof) may be inserted within compartments 102, 104 during operations. For instance, in some embodiments, $L_{100}$ may range from about 5 to about 20 inches, or from about 10 to about 20 inches, or from about 10 to about 15 inches.

In addition, as is best shown in FIG. 4, compartments 102, 104 each have a corresponding width $W_{102}$, $W_{104}$ that extends generally perpendicular to length $L_{100}$ (e.g., when pocket 100 is laid flat). In some embodiments, the widths $W_{102}$, $W_{104}$ of compartments 102, 104, respectively, may be sufficiently large so as to receive a breaching charge (not shown therein), but small enough to so as to restrict some or all of the movement of a breaching charge within compartments 102, 104. For instance, in some embodiments, widths $W_{102}$, $W_{104}$ may range from about 1 inch to about 5 inches, or form about 2 inches to about 4 inches.

In light of the particular widths $W_{102}$, $W_{104}$ and length $L_{100}$ discussed above, it should be appreciated that the compartments 102, 104 of pockets 100 may have an aspect ratio of length to width (e.g., $L_{100}/W_{102}$ or $L_{100}/W_{104}$) that is configured to allow pocket to receive and retain a breaching charge while preventing excess movement thereof during operations. In at least some embodiments, the length to width ratio of compartments 102, 104 (e.g., $L_{100}/W_{102}$ and $L_{100}/W_{104}$, respectively) may range from about 2 to about 7, or from about 4 to about 5.

Referring specifically to FIG. 4, in some embodiments, a plurality of elastic loops 110 are mounted to pants 10, proximate breaching charge pocket(s) 100. In particular, in some embodiments, loops 110 are mounted to pants 10 at each opening 101, 103 of compartments 102, 104, respectively. Thus, in the embodiment of FIG. 4, there are two loops 110. Each of the loops 110 comprise an elastic band or tether, such that they may be elastically stretched or enlarged during operations. As will be described in more detail below, each loop 110 may be disposed about a breaching charge (not shown) that is inserted within the corresponding compartment 102, 104 such that loops 110 may retain or hold the breaching charge (not shown) in a desired position within compartments 102, 104.

Figure 7:
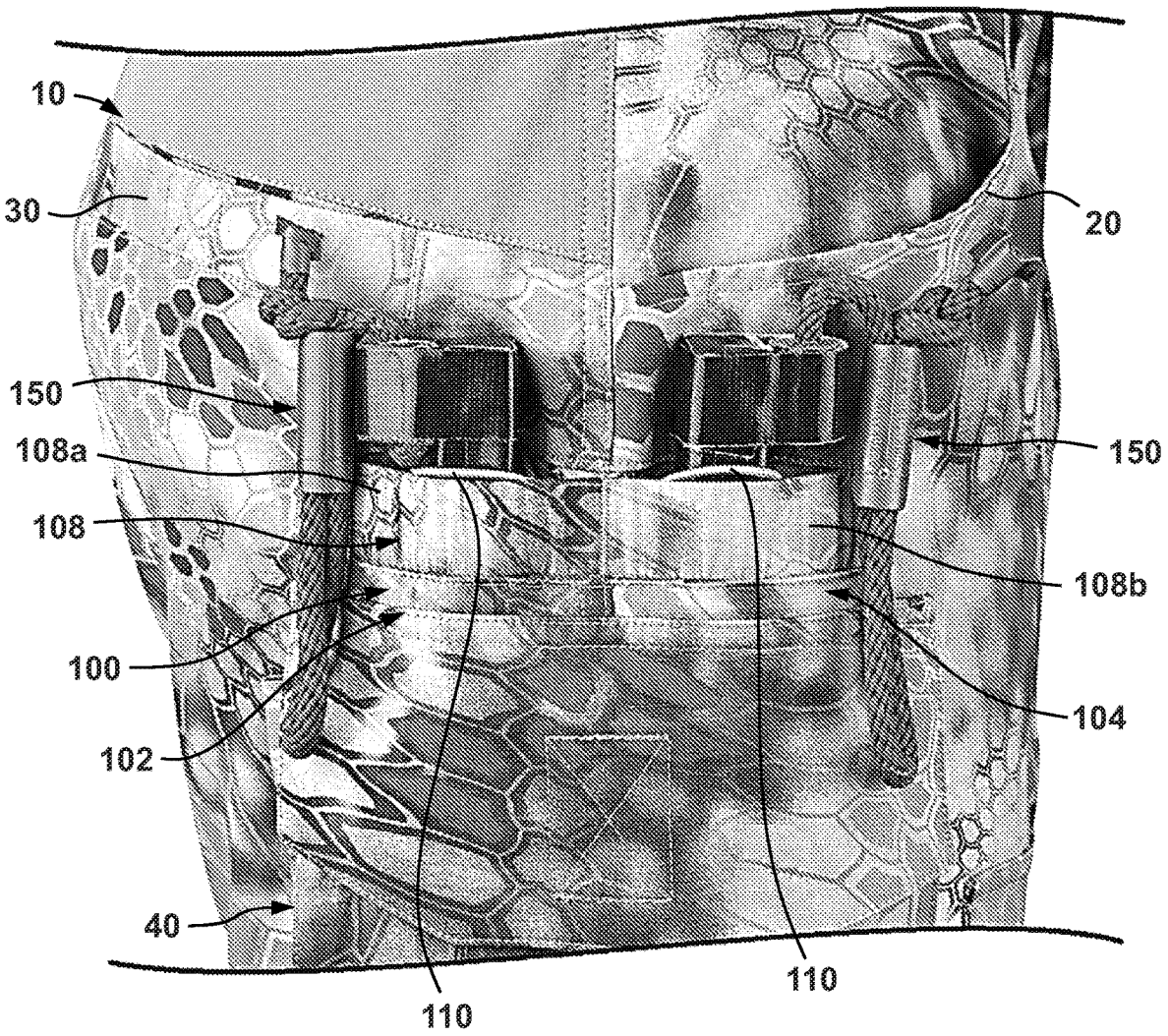
FIG. 7 is a front, external view of a breaching charge pocket of the pants of FIG. 1 with a pair of breaching charges inserted therein according to some embodiments.

Referring now to FIG. 7, during operations, a breaching charge 150 may be inserted within one or all of the compartments 102, 104 of breaching charge pockets 100. In some embodiments, breaching charges 150 are generally elongate members that have a length that is longer than the total length $L_{100}$ of pocket 100. As a result, a portion of breaching charges 150 is exposed above the upper ends 102*a*, 104*a* of compartments 102, 104. In addition, when breaching charges 150 are inserted within compartments 102, 104, elastic loops 110 are wrapped about the breaching charges 150 so as to prevent the breaching charges 150 from moving about within compartments 102, 104 during operations. Similarly, the elastic materials (not shown) within portions 108*a*, 108*b* of welt 108 also help to retain or hold the position of breaching charges 150 within compartments 102, 104 during operations. Accordingly, breaching charges 150 are secured within compartments 102, 104 of pocket 100 such that they are relatively stable and are easily accessible by personnel when needed (e.g., such as to perform a door breaching operation as described above). Thus, pockets 100 (and pants 10 which incorporate pockets 100) may enhance and facilitate the safe and effective storage and handling of door breaching charges by personnel.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

As used in this specification, including the claims, the term "and/or" is a conjunction that is either inclusive or exclusive. Accordingly, the term "and/or" either signifies the presence of two or more things in a group or signifies that one selection may be made from a group of alternatives.

Without further elaboration, it is believed that one skilled in the art can use the preceding description to utilize the claimed inventions to their fullest extent. The examples and embodiments disclosed herein are to be construed as merely illustrative and not a limitation of the scope of the present disclosure in any way. It will be apparent to those having skill in the art that changes may be made to the details of the above-described embodiments without departing from the underlying principles discussed. In other words, various modifications and improvements of the embodiments specifically disclosed in the description above are within the scope of the appended claims. For example, any suitable combination of features of the various embodiments described is contemplated. Note that elements recited in means-plus-function format are intended to be construed in accordance with 35 U.S.C. § 112 ¶6. The scope of the invention is therefore defined by the following claims.

The invention is claimed as follows:

1. A pair of pants, comprising:

a pair of pant legs; and a first pocket coupled to a first pant leg of the pair of pant legs, wherein the first pocket comprises:

a plurality of compartments, wherein each compartment includes an upper end and a lower end, and wherein the upper end of each compartment includes an opening that is biased to a closed position; and a plurality of elastic loops, wherein each elastic loop comprises an elastic band having opposing ends directly coupled together at the opening of a corresponding one of the plurality of compartments, and wherein the elastic loop is configured to be stretched to wrap about an entire circumference of a breaching charge when the breaching charge and a portion of the elastic loop is placed within the corresponding one of the plurality of compartments.

2. The pair of pants of claim 1, comprising a first side cargo pocket coupled to the first pant leg, and further comprising a front pocket on the first pant leg, wherein the opening of each compartment of the first pocket is disposed between an opening of the front pocket and the first side cargo pocket along the first pant leg.

3. The pair of pants of claim 2, wherein at least a portion of the compartments is attached to an inside surface of the first pant leg behind and centered laterally between horizontal extents of the first side cargo pocket and is configured to be between the first side cargo pocket and a leg of a user when worn.

4. The pair of pants of claim 1, wherein the first breaching charge pocket comprises a welt that defines the opening of each of the compartments.

5. The pair of pants of claim 4, wherein the welt comprises an elastic material that is configured to bias the openings to the closed position.

6. The pair of pants of claim 1, wherein the first pocket comprises a length that ranges from about 10 inches to about 20 inches.

7. The pair of pants of claim 1, wherein the first pocket comprises a length that ranges from about 15 inches to about 20 inches.

8. The pair of pants of claim 1, wherein each of the plurality of elastic loops is configured to be elastically enlarged and then released about the respective breaching charge to retain the respective breaching charge within the corresponding one of the plurality of compartments.

9. The pair of pants of claim 1, comprising a second pocket coupled to a second pant leg of the pair of legs, wherein the second pocket comprises:

a plurality of second compartments, wherein each second compartment includes an upper end and a lower end, and wherein the upper end of each second compartment includes an opening that is biased to a closed position; and a plurality of second elastic loops, wherein each second elastic loop comprises an elastic band having opposing ends coupled together above at an open end of a corresponding one of the plurality of second compartments.

10. The pair of pants of claim 9, wherein the second pocket comprises a welt that defines the opening of each of the second compartments.

11. A pair of pants, comprising:

a pair of pant legs;

a first pocket coupled to a first pant leg of the pair of pant legs, wherein the first pocket comprises:

a plurality of first compartments, wherein each first compartment includes an upper end and a lower end, and wherein the upper end of each first compartment includes an opening that is biased to a closed position;

a second pocket coupled to a second pant leg of the pair of pant legs, wherein the second pocket comprises:

a plurality of second compartments, wherein each second compartment includes an upper end and a lower end, and wherein the upper end of each second compartment includes an opening that is biased to a closed position;

a plurality of first elastic loops and a plurality of second elastic loops wherein one loop of the plurality of first elastic loops comprises an elastic band having opposing ends directly coupled together at the opening of a corresponding one of the plurality of first compartments, and one loop of the plurality of second elastic loops comprises an elastic band having opposing ends directly coupled together above at the opening of a corresponding one of the plurality of second compartments; and wherein the pluralities of first and second elastic loops are each configured to be stretched to wrap about an entire circumference of a corresponding breaching charge when the corresponding breaching charge and a portion of the corresponding one of the pluralities of first and second elastic loops is placed within the corresponding one of the pluralities of first and second compartments.

12. The pair of pants of claim 11, comprising a first side cargo pocket coupled to the first pant leg, a second side cargo pocket coupled to the second pant leg, and further comprising a first front pocket with an opening and a second front pocket with an opening, wherein the opening of each first compartment is disposed between the first front pocket's opening and the first side cargo pocket and the opening of each second compartment is disposed between the second front pocket's opening and the second side cargo pocket.

13. The pair of pants of claim 11, wherein each of the first and second pluralities of elastic loops is configured to be elastically enlarged and then released about the respective corresponding breaching charge to retain the respective corresponding breaching charge within the corresponding one of the pluralities of first and second compartments when the respective corresponding breaching charge and a portion of the respective elastic loop is placed within the corresponding one of the pluralities of first and second compartments.

14. The pair of pants of claim 11, wherein the first pocket comprises a welt that defines the opening of each of the first compartments.

15. The pair of pants of claim 14, wherein the welt comprises an elastic material that is configured to bias the openings to the closed position.

16. The pair of pants of claim 11, wherein the second pocket comprises a welt that defines the opening of each of the second compartments.

17. The pair of pants of claim 11, wherein the first pocket comprises a length that ranges from about 10 inches to about 20 inches.

18. The pair of pants of claim 17, wherein the length of the first pocket is different from a length of the second pocket.

19. The pair of pants of claim 11, wherein the first pocket comprises a length that ranges from about 15 inches to about 20 inches.

* * * * *